US005172867A

United States Patent [19]

Whitney

[11] Patent Number: 5,172,867

[45] Date of Patent: Dec. 22, 1992

[54] UTILIZATION OF A PAPER PULP DIGESTER AS A STRUCTURAL SUPPORT

[75] Inventor: James M. Whitney, Glens Falls, N.Y.

[73] Assignee: Kamyr, Inc., Glens Falls, N.Y.

[21] Appl. No.: 756,553

[22] Filed: Sep. 9, 1991

[51] Int. Cl.[5] ..... D21C 7/00

[52] U.S. Cl. ..... 241/30; 241/285.1; 162/19; 162/237; 162/242

[58] Field of Search ..... 241/46.17, 285.1, 30; 162/19, 68, 237, 242

[56] References Cited

U.S. PATENT DOCUMENTS 2,178,266 10/1939 Pomilio ..... 162/237 X 3,471,365 10/1969 Asplund ..... 162/237

OTHER PUBLICATIONS

Marked up photographs of admitted prior public use device, publication date unknown.

Kamyr Continuous Cooking and Washing System Bulletin No. KGD 1802-WNT288, Jul. 1988.

*Primary Examiner*—Frank T. Yost

*Assistant Examiner*—Raymond D. Woods

*Attorney, Agent, or Firm*—Nixon & Vanderhye

[57] ABSTRACT

A continuous, upright, digester for paper pulp is utilized as a structural support for accessory vessels, such as a chip bin and flash tanks. Generally horizontal steel beams are connected to the digester and extend outwardly from opposite sides of the digester vessel. One set of beams is connected to the impregnation vessel, and supports the chip bin on them. A steaming vessel may be mounted on a horizontal platform below the chip bin. On the opposite side of the digester, the second horizontal beams extend to a pair of vertical legs spaced apart approximately the diameter of the digester. First and second flash tanks, one above the other, are supported by the second set of horizontal beams, and a third set below the second set, those beams—and structures connected to them—being the only support for the flash tanks.

20 Claims, 4 Drawing Sheets

UTILIZATION OF A PAPER PULP DIGESTER AS A STRUCTURAL SUPPORT

BACKGROUND AND SUMMARY OF THE INVENTION

One problem that is prevalent in mills for making paper pulp is effective utilization of space. Also, mill construction costs are high, especially when—as in many modern mills—the vessels used for production of pulp are large, sometimes having a height of well over a hundred feet.

According to the present invention, a method and apparatus are provided which address these two problems in modern paper mills. According to the present invention, support for a number of accessory vessels is provided by already existing main vessels, such as the continuous digester itself and an impregnation vessel, if present. The continuous digester is typically the largest vessel found in the pulp mill, often extending to heights of over a hundred feet, and having excellent structural integrity. Because the digester vessel must be capable of holding large volumes of wood chips, or other comminuted cellulosic fibrous material, and liquid slurry under high pressure and temperature conditions, it is a massive, well-built, structurally sound vessel.

According to the invention, the structural integrity of the continuous digester is taken advantage of in providing an arrangement of components that minimizes the amount of structural steel that is necessary in order to support all of the components normally associated with the pulp mill while effectively utilizing space. As a matter of fact, according to the invention, it is possible to provide ready maintenance areas for a number of the vessels while also achieving the objectives set forth above.

According to one aspect of the present invention, a method of structurally supporting accessory vessels cooperating with an upright continuous digester for producing paper pulp from comminuted cellulosic fibrous material, is provided. The method comprises the steps of (a) providing a first structural support extending outwardly from a side of the digester, between the top and bottom thereof with expansion joints, such as on bridges, to compensate for the thermal expansion from the cold (non-operating) to the hot condition (operating); (b) providing a second, vertical, structural support independent of the digester and adjacent to it; and (c) operatively connecting at least one accessory vessel which feeds liquid or material to, or receives liquid or material from, the digester, to the first structural support so that the accessory vessel is vertically supported by the digester and the second vertical supports.

The at least one accessory vessel preferably comprises a chip bin with a horizontal steaming vessel mounted under the chip bin on a separate support system. It is also preferable to provide the further steps of providing a third structural support extending outwardly from the opposite side of the digester, providing a fourth vertical, structural support independent of the digester and adjacent to it; and operatively connecting an additional accessory vessel to the third structural support so that that additional accessory vessel is vertically supported by the digester and the second vertical supports, and no other structures.

A second vertical structural support provided according to the invention may be an impregnation vessel, while the fourth structural support comprises a pair of vertical beams or legs. The first and third structural supports comprise generally horizontally extending pairs of beams from the digester's opposite sides, the beams engaging side supports or portions of the accessory vessels, and cross members preferably being provided between the beams at the accessory vessels.

The invention also comprises a superstructure assembly of vessels. The superstructure comprises an upright continuous digester having a top, bottom, and sides, a material inlet to the top, and a pulp inlet from the bottom, and containing a slurry of material and liquid; an accessory vessel connected to the digester to feed liquid or material to the digester, or receive liquid or material from the digester; a first structural support extending outwardly from a side of the digester, and vertically supported by the digester; a second, vertical, structural support adjacent to, but spaced from, the digester, and connected to the first structural support to assist the digester in vertically supporting it; and the accessory vessel engaging and vertically supported by the first structural support.

The invention—according to another aspect—also comprises the following: An upright continuous digester having first and second, opposite sides. An upright impregnation vessel adjacent, but spaced from, the digester. A chip bin. A flash tank. A first pair of generally horizontally extending beams connected at one end to a first side of the digester and at the opposite end to the impregnation vessel, the chip bin being supported only by the first pair of beams and elements connected thereto. This connection would be designed to accommodate for thermal expansion. A pair of vertical legs adjacent, but spaced from, the digester and spaced apart a distance roughly corresponding to the diameter of the digester. A second pair of generally horizontal beams connected to the second side of the digester and extending therefrom to the vertical legs. And, the flash tank being supported only by the second horizontal beams and structures connected thereto.

It is the primary object of the present invention to provide for the effective utilization of space in a pulp mill and to minimize the amount of structural steel necessary for supporting the vessels utilized for the production of paper pulp in the mill. This and other objects of the invention will become clear from an inspection of the detailed description of the invention and from the appended claims.

DETAILED DESCRIPTION OF THE DRAWINGS

Figure 1:
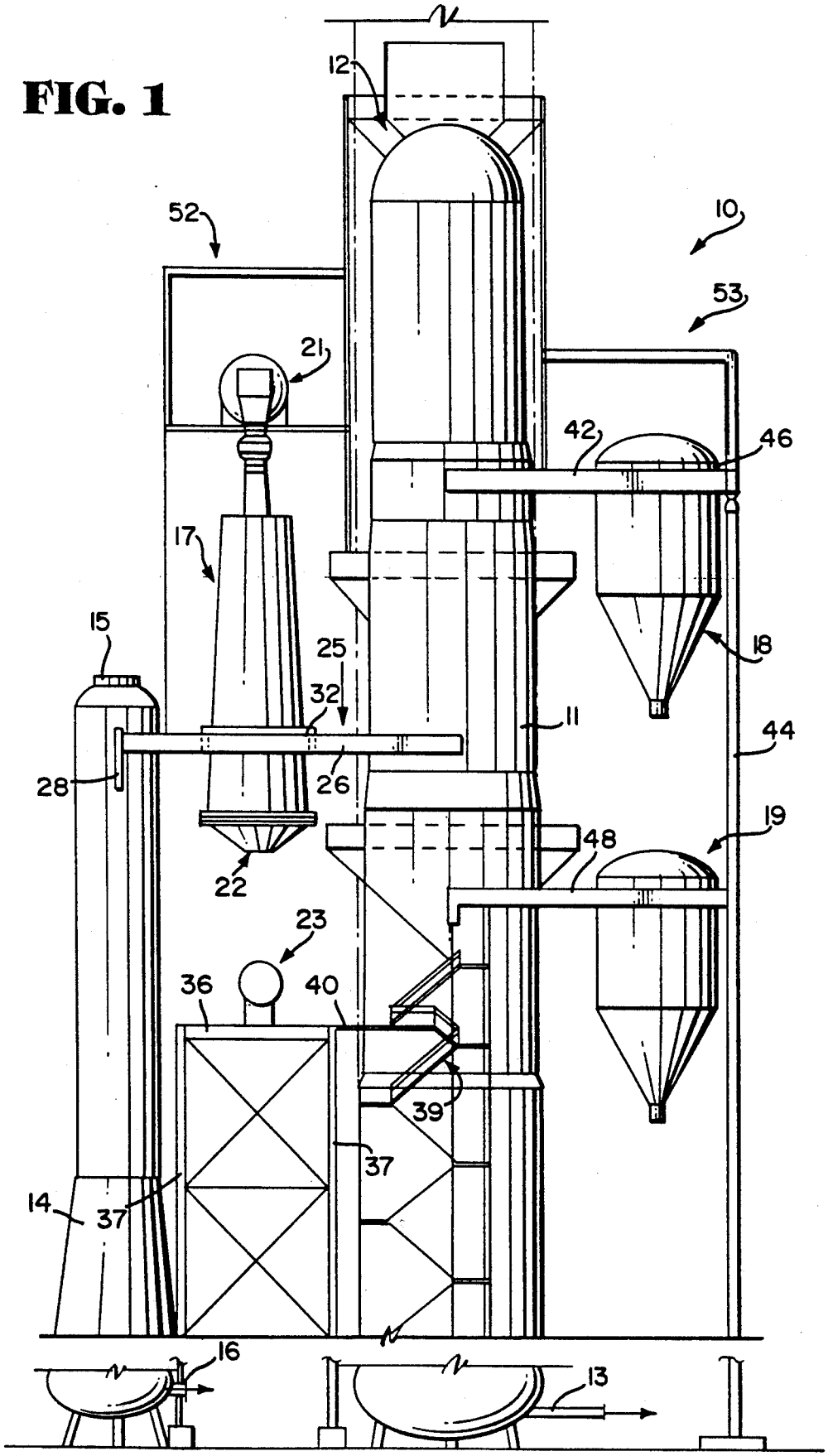
FIG. 1 is an end view of an exemplary superstructure assembly according to the invention.

A superstructure assembly according to the present invention is illustrated schematically generally at reference numeral 10 in all of FIGS. 1–4. The superstructure assembly is utilized in conjunction with a conventional pulp mill having a conventional continuous digester 11. The conventional continuous digester 11 has an inlet at the top thereof, shown generally by reference numeral 12, for receiving comminuted cellulosic fibrous material (e.g., wood chips) to be digested, and at the bottom thereof (see FIG. 1) it has an outlet 13 for the discharge of paper pulp produced by the digester 11. The digester 11 is typically very tall (e.g., over 150 feet), and has high structural integrity.

Figure 3:
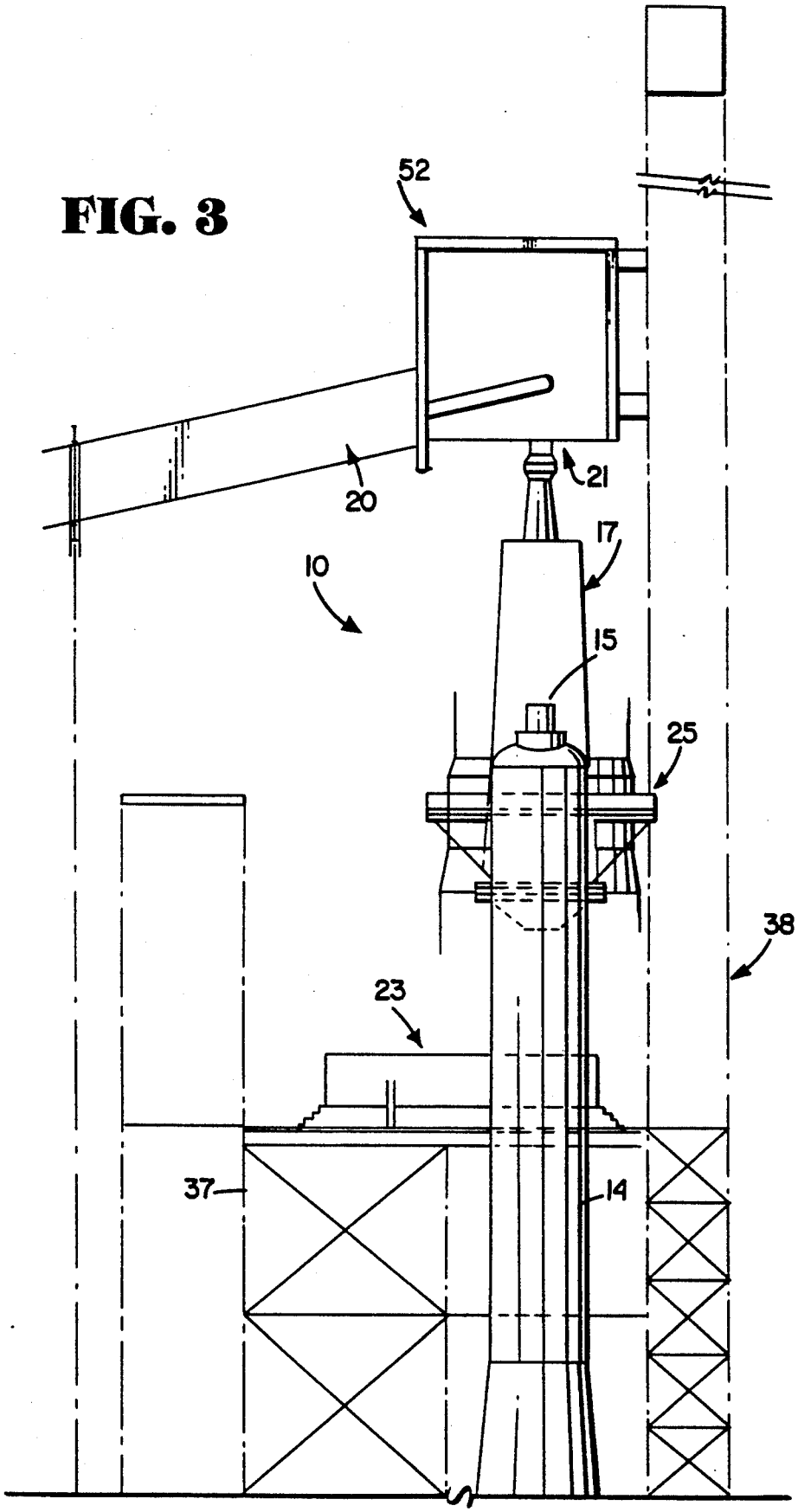
FIG. 3 is a side view of the assembly of FIG. 1 looking in at the left, with portions of the digester removed for clarity of illustration.
Figure 4:
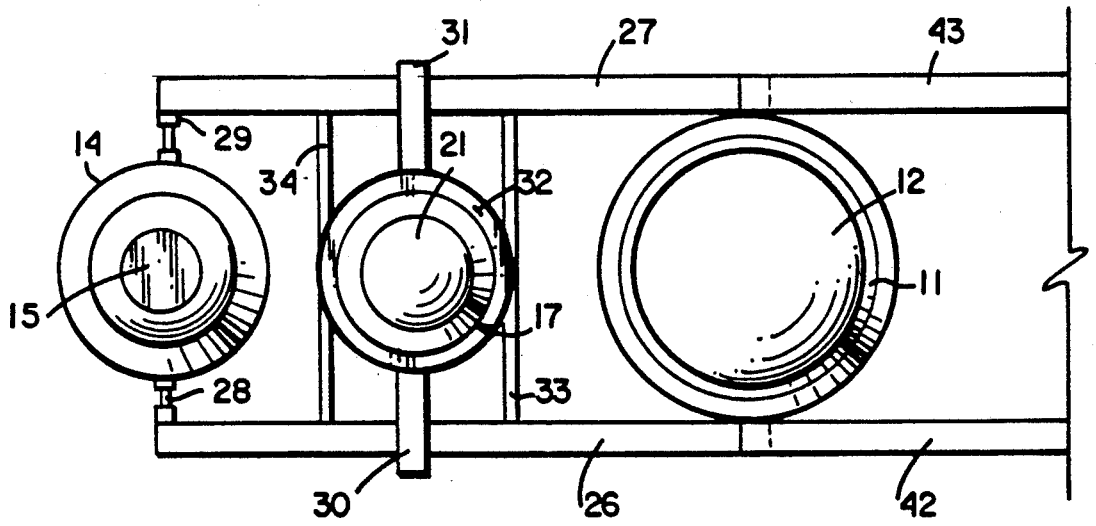
FIG. 4 is a schematic top plan view showing the components on the left-hand side of the assembly of FIG. 1.

Also illustrated in FIGS. 1, 3 and 4 is a second conventional vessel utilized in the preferred embodiment, namely an impregnation vessel 14. The impregnation vessel 14 also has an inlet 15 at the top thereof for comminuted cellulosic fibrous material and an outlet 16 at the bottom thereof (see FIG. 1) for cellulosic material that has been impregnated with treatment liquid. This vessel 14 also typically is upright and has substantial structural integrity.

Figure 2:
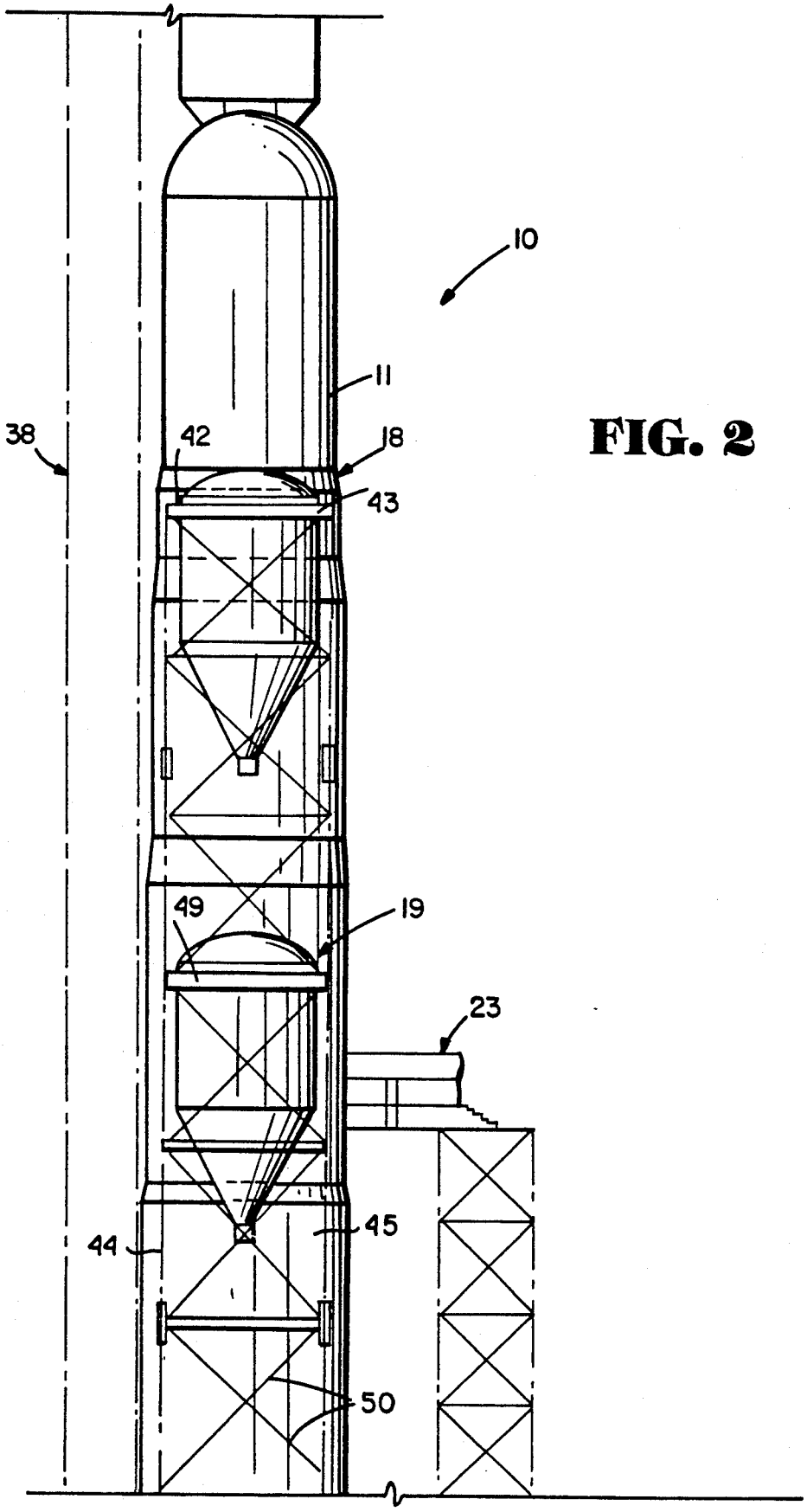
FIG. 2 is a side view of the assembly in FIG. 1 looking in on the right thereof.

Other conventional, per se, structures illustrated in the various drawing figures are the chip bin 17 (FIGS. 1, 3 and 4) and first and second flash tanks 18, 19 (FIGS. 1 and 2).

The chip bin 17 is typically the initial vessel for receiving the wood chips or other comminuted cellulosic fibrous material, e.g., from a conveyor 20 (see FIG. 3), and has an inlet 21 at the top thereof, and an outlet 22 at the bottom thereof. In normal operation, the outlet 22 of the chip bin 17 is connected to a chip meter, low pressure feeder and then to a horizontal steaming vessel 23 in which the chips are steamed with the outlet from the steaming vessel 23 being connected through a chip chute and a conventional high pressure feeder (not shown) to the top of the impregnation vessel 14.

The flash tanks 18, 19, rather than feeding comminuted cellulosic material to the digester 11, receive liquid discharged from the vessel 11. For example, in the typical use of the flash tanks 18, 19, black liquor is withdrawn from an intermediate portion of the digester 11 and is flashed in the first flash tank 18, with the remaining liquid from the first flash tank 18 being fed to the second flash tank 19. The steam flashed off in the tanks 18, 19 is otherwise used in the pulp processing system, while the liquid—after a suitable number of flashing stages—is ultimately recovered, burned, or otherwise utilized.

According to the present invention, a first structural support—illustrated generally by reference numeral 25 in FIGS. 1 and 3—extends outwardly from a first side of the digester 11 (the left side in FIG. 1) and is vertically supported at one end by the digester 11. The first structural support preferably comprises a pair of generally horizontal steel beams 26, 27 (see FIGS. 1 and 4) which are welded or otherwise attached, at the right end thereof (as seen in FIGS. 1 and 4) to the circumferential periphery of the digester 11, or to I-beam sections or other extensions, from the vessel 11. At the opposite ends of the beams 26, 27, they are connected to a second, vertical, structural support adjacent to, but spaced from, the digester and connected to the first structural support 25 to assist the digester in vertically supporting it. In the preferred embodiment illustrated in the drawings, the second structural support comprises the impregnation vessel 14. The left hand ends of the beams 26, 27 (as viewed in FIGS. 1 and 4) are connected at the their ends opposite the digester 11 to the opposite sides of the impregnation vessel 14 or to I-beam sections 28, 2g (see FIG. 4 in particular) extending outwardly from the impregnation vessel 14. Attachment is by a conventional expansion joint (e.g. on pins and roller), to accommodate for thermal expansion, or under some circumstances could be by welding and/or other suitable mechanism, such as rivets, bolts or nuts.

The steel beams 26, 27 vertically support the chip bin 17, and—with structures connected thereto—comprise the only vertical support for the chip bin 17. This may be accomplished—as illustrated in FIGS. 1, 3 and 4—by the beams 26, 27 disposed under, and engaging and supporting, the pair of horizontal support portions 30, 31 connected to the chip bin and extending radially outwardly therefrom. Also, an annular support section 32 of the chip bin may be provided (of which the portions 30, 31 may be merely be enlargements, or—depending on the particular dimensions and configurations of the components—the portions 30, 31 may be part of the ring 32). Other sections of the annular support 32 may rest upon the cross steel beams 33, 34 (see FIG. 4), which are welded or otherwise attached at the ends thereof to the beams 26, 27.

While one form of the first structural support—in the form of the beams 26, 27, 33, 34, and support sections 28, 29, etc.—has been described, it is to be understood that other mechanisms could be utilized, the entire purpose being to take advantage of the structural integrity of the continuous digester 11 to support important accessory vessels, like the chip bin 17.

To further maximize the utilization of space—and to also allow easy access for maintenance and repair—it is desirable to mount the horizontal steaming vessel 23 directly below the chip bin 17 as illustrated in FIG. 1 and 3. This mounting also facilitates interconnection of those two components 17, 23, which are typically directly connected to each other (typically through a low pressure feeder or the like). A steaming vessel 23 preferably is mounted on a horizontal platform 36, which is supported by a number of supporting legs, such as the legs 37.

Platform 36 may be supported at its end opposite the legs 37 by an elevator shaft and stair tower 38 which is conventional in many pulp mills in association with digesters in order to allow access to all levels of the digester for maintenance and repair. To facilitate utilization of the horizontal platform 36 on which steaming vessel 23 is mounted, a stairwell 39 (see FIG. 1) may be provided that is connected to the front end of the digester 11 (as viewed in FIG. 1), and an access platform 40 extending from the stairwell 39 to the horizontal platform 36.

The digester 11 is capable of supporting more than one accessory vessel. As illustrated in the preferred embodiment, and as particularly seen in FIGS. 1 and 2, the digester 11 mounts the flash tanks 18, 19 at the opposite side thereof as the chip bin 17. For mounting the top flash tank 18, a third structural support—which may be in the form of the generally horizontal steel beams 42, 43 (see FIGS. 1 and 4)—is provided, which are attached to the sides of the digester 11 and extend in the direction opposite the direction of the beams 26, 27; or the beams 42, 43 can be connected to I-beams or like sections extending outwardly from the sides of the digester 11. At the opposite end of the beams 42, 43 from the digester 11, is a fourth, vertical, support in the form of a pair of vertical columns, poles, or legs 44, 45 (see FIGS. 1 and 2). Any suitable mechanism may be utilized to actually connect the beams 42, 43 and legs 44, 45 so that they operatively support the flash tank 18 including an annular section 46 on the flash tank 18 that rests on the beams 42, 43, a structure—including cross beams—completely surrounding the tank 18 or the like.

In order for space convenience and optimum utilization, a second flash tank 19 is preferably mounted directly below the first flash tank 18 (typically being connected thereto in any event). In this way, the flash tanks are mounted directly adjacent to the black liquor discharge from the digester 11, and are easily connected to this discharge from the digester 11. A fifth structural support means—indicated by the generally horizontal beam 48 and a like beam (not seen) on the opposite side of the flash tank as viewed in FIG. 1—may be provided for supporting flash tank 19, as well as a cross beam or beams (such as a cross beam 49 illustrated in FIG. 2) or the like. Also, various bracing mechanisms, known per se, such as the braces 50 (see FIG. 2) may be provided to insure sufficient rigidity of the vertical legs 44, 45.

Note that it is particularly desirable to provide the construction illustrated in FIGS. 1–4 since this way the digester structure has been balanced by providing accessory vessels on opposite sides of the digester. While an accessory vessel could be supported only on one side of the digester 11, supporting accessory vessels on both sides—as illustrated in the drawings—not only leads to better space utilization and a minimum amount of structural steel, but also insures structural integrity of the entire superstructure since the horizontal forces on the opposite sides of vessel 11 are countered to some extent.

The structures illustrated in the drawings also include various roofs which may be utilized to cover various components. For example, a roof section 52 (see FIGS. 1 and 3) may be provided to cover the interconnection between the conveyor 20 and the inlet 21 to the chip bin 17 to protect it from the elements. The roof section 52 is operatively connected by various supports to the elevator shaft and stair tower 38. The roof 52 is a relatively light structure, and non-load bearing so that it is easily supported. It may be slanted, if necessary, to shed snow and ice.

A similar roof structure 53 may be mounted on the opposite side of the digester 11 from the roof 52, also connected to the stair and elevator tower 38, and covering the flash tanks 18, 19. Roofs can be provided over the impregnation vessel 14, and for the digester 11, too, if desired.

The invention relates—in addition to the structural components mentioned above—to a method of structurally supporting accessory vessels cooperating with an upright continuous digester 11 for producing paper pulp from comminuted cellulosic fibrous material. The method may comprise the following steps:

(a) Providing a first structural support (26, 27) extending outwardly from the side of the digester (e.g., horizontally) between the top and bottom 12, 13 thereof.

(b) Providing a second, vertical structural support independent of the digester and adjacent to it (e.g., the impregnation vessel 14).

(c) Operatively connecting at least one accessory vessel (e.g., chip bin 17) which feeds liquid or material to, or receives liquid or material from (e.g., flash tanks 18, 19) the digester 11, to the first structural support (26, 27) so that the accessory vessel (17) is vertically supported by the digester (11) and the second vertical support (impregnation vessel 14). Preferably also the steaming vessel 23 is mounted on a horizontal platform beneath the chip bin 17, access to the steaming vessel may be provided by stairwell 39.

The invention also preferably also contemplates the steps of:

(d) Providing a third structural support (the generally horizontal beams 42, 43) extending outwardly from the opposite side of the digester 11;

(e) Providing a fourth vertical, structural support (vertical legs 44, 45) independent of digester 11 and adjacent to it; and (f) Operatively connecting at least one additional accessory vessel (flash tank 18) to the third structural support (beams 42, 43) so that the additional vessel 18 is vertically supported by the digester 11 and fourth vertical supports (44, 45), no additional vertical supports being necessary, or utilized. The structural support in the form of the generally horizontal beam 48 (and a companion beam on the opposite side thereof) supports the second flash tank 19 beneath the first flash tank 18.

It will thus be seen that according to the present invention a pulp mill design, a method and a superstructure assembly, have been provided which optimize the utilization of space in a mill, and which minimize the amount of structural steel necessary to support the large essential elements of the pulp production process.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent assemblies and processes.

What is claimed is:

1. A method of structurally supporting accessory vessels cooperating with an upright continuous digester for producing paper pulp from comminuted cellulosic fibrous material, the digester fed with material from the top, and discharging produced pulp from the bottom, said method comprising the steps of:

(a) providing a first structural support extending outwardly from a side of the digester, between the top and bottom thereof;

(b) providing a second, vertical, structural support independent of the digester and adjacent to it; and (c) operatively connecting at least one accessory vessel which feeds liquid or material to, or receives liquid or material from, the digester, to the first structural support so that the accessory vessel is vertically supported by the digester and the second vertical support.

2. A method as recited in claim 1 wherein the at least one accessory vessel is a chip bin; and comprising the further step (d) of mounting a horizontal steaming vessel under the chip bin.

3. A method as recited in claim 2 wherein step (d) is practiced by mounting the steaming vessel on a horizontal support extending between a pair of vertical supports each extending upwardly from the ground.

4. A method as recited in claim 3 comprising the further step (e) of providing access to the steaming vessel by a stairway supported by the digester.

5. A method as recited in claim 2 wherein step (b) is practiced by providing an impregnating vessel as the second structural support, the chip bin operatively connected to the digester through the steaming vessel and the impregnation vessel.

6. A method as recited in claim 1 comprising the further steps of:

(d) providing a third structural support extending outwardly from a side of the digester, between the top and bottom thereof, opposite the first support;

(e) providing fourth vertical supports; and (f) operatively connecting at least one additional accessory vessel which feeds liquid or material to, or receives liquid or material from, the digester, to the third structural support so that the additional accessory vessel is vertically supported by the digester and the fourth vertical supports.

7. A method as recited in claim 6 wherein the at least one accessory additional vessel is a first flash tank, and wherein step (e) is practiced by providing a pair of upright steel beams as the fourth vertical supports.

8. A method as recited in claim 7 comprising the further steps of (g) providing a fifth structural support extending outwardly from a side of the digester in a substantially common plane with said third support and also connected to the upright steel beams; and (h) providing a second flash tank mounted to the fifth structural support below the first flash tank.

9. A method as recited in claim 1 comprising the further steps of (d) constructing a roof over the accessory vessel; (e) constructing a stair and elevator tower adjacent the digester; and (f) at least partially supporting the roof with the stair and elevator tower.

10. A method as recited in claim 1 wherein the accessory vessel has at least a pair of horizontal support portions on opposite sides thereof; and wherein step (a) is practiced by providing a pair of horizontal steel beams, each connected at one end thereof to the digester by thermal expansion joints, and at the other end thereof to the second vertical structural support; and wherein step (c) is practiced by mounting the accessory vessel between the horizontal steel beams so that the horizontal support portions thereof engage, and are supported by, the horizontal steel beams.

11. A superstructure assembly of vessels for producing paper pulp from comminuted, cellulosic fibrous material, comprising:

an upright continuous digester having a top, bottom, and sides, a material inlet to the top, and a pulp outlet from the bottom, and containing a slurry of material and liquid;

an accessory vessel connected to the digester to feed liquid or material to the digester, or receive liquid or material from the digester;

a first structural support extending outwardly from a side of the digester, and vertically supported by the digester;

a second, vertical, structural support adjacent to, but spaced from, the digester, and connected to the first structural support to assist the digester in vertically supporting the first structural support; and said accessory vessel engaging and vertically supported by said first structural support.

12. A superstructure assembly as recited in claim 11 wherein said accessory vessel comprises a chip bin having an inlet at the top thereof for comminuted cellulosic fibrous material and an outlet at the bottom thereof, the outlet operatively connected to the inlet to the digester.

13. A superstructure assembly as recited in claim 12 wherein said first structural support comprises a pair of steel beams extending from said digester to said second structural support, and wherein said chip bin has a pair of horizontal support portions on opposite sides thereof, said steel beams engaging said horizontal support portions.

14. A superstructure assembly as recited in claim 13 wherein said second structural support comprises an impregnation vessel, said pair of steel beams being connected to opposite sides of said impregnation vessel, said impregnation vessel having an inlet at the top thereof that is operatively connected to the outlet of said chip bin, and an outlet at the bottom thereof operatively connected to the inlet to said digester.

15. A superstructure assembly as recited in claim 13 wherein said first structural support further comprises a pair of cross members extending between said pair of steel beams, adjacent said chip bin, and engaging extensions of said chip bin to facilitate support of said chip bin thereby.

16. A superstructure assembly as recited in claim 12 further comprising a steaming vessel mounted below said chip bin on a horizontal support, the outlet to said chip bin being connected to said steaming vessel, and an outlet from said steaming vessel being operatively connected to said digester.

17. A superstructure assembly as recited in claim 11 comprising an additional accessory vessel connected to the digester to feed liquid or material to the digester, or receive liquid or material from the digester; a third structural support extending outwardly from a side of said digester opposite the side from which said first structural support extends and vertically supported by the digester; a fourth, vertical, structural support adjacent to, but spaced from, the digester, and connected to the third structural support to assist the digester in vertically supporting the third structural support; and said additional accessory vessel engaging and vertically supported by said third structural support.

18. A superstructure assembly as recited in claim 17 wherein said fourth structural support comprises a pair of vertical beams extending from the ground to said third structural support.

19. A superstructure assembly as recited in claim 18 wherein said additional accessory vessel comprises a flash tank; and further comprising a second flash tank mounted under said flash tank, said second flash tank supported by a fifth structural support extending between said digester and said fourth structural support in a plane containing said third structural support.

20. An arrangement of vessels in a pulp mill comprising:

an upright continuous digester having first and second, opposite sides;

an upright impregnation vessel adjacent, but spaced from, said digester;

a chip bin;

a flash tank;

a first pair of generally horizontally extending beams connected at one support thereof to a first side of said digester, and at opposite ends thereof to said impregnation vessel, said chip bin being supported only by said first pair of beams connected thereto;

a pair of vertical legs adjacent, but spaced from, said digester and spaced apart a distance roughly corresponding to a diameter of said digester;

a second pair of generally horizontal beams connected to the second side of said digester and extending therefrom to said vertical legs; and said flash tank supported only by said second pair of horizontal beams connected thereto.

* * * * *